United States Patent [19]

Leskovec et al.

[11] Patent Number: 4,987,347

[45] Date of Patent: Jan. 22, 1991

[54] LAMP DRIVER CIRCUIT

[75] Inventors: Robert A. Leskovec, Highland Heights; John M. Davenport, Lyndhurst; Joseph M. Allison, Euclid, all of Ohio

[73] Assignee: General Electric Company, Schenectady, N.Y.

[21] Appl. No.: 320,726

[22] Filed: Mar. 8, 1989

[51] Int. Cl.[5] ..... H05B 39/00; H05B 41/14

[52] U.S. Cl. ..... 315/209 R; 315/226; 315/239; 315/240; 315/289; 315/DIG. 2; 315/DIG. 7

[58] Field of Search ..... 315/200 R, 205, 209 R, 315/209 CD, 209 T, 209 M, 226, 227 R, 239, 240, 244, 290, DIG. 2, DIG. 5, DIG. 7, 289

[56] References Cited

U.S. PATENT DOCUMENTS

| | | | |
|---|---|---|---|
| 4,170,746 | 10/1979 | Davenport | 315/246 |
| 4,184,128 | 1/1980 | Nilssen | 331/113 A |
| 4,553,070 | 11/1985 | Sairanen et al. | 315/209 R |

*Primary Examiner*—David Mis

*Attorney, Agent, or Firm*—John P. McMahon; Stanley C. Corwin; Fred Jacob

[57] ABSTRACT

A lamp driver circuit is presented herein for driving a lamp circuit with an AC squarewave voltage at a relatively high frequency. The driver circuit includes a self-oscillating half-bridge circuit having a pair of input terminals connected across a DC voltage supply, which may be obtained from rectifying an AC voltage signal, and a pair of output terminals connected across a lamp circuit including a lamp, either a resistive lamp or a gaseous discharge lamp, to be energized. The circuit also includes a pair of capacitors connected together in series across the input terminals and having a junction therebetween connected to a first one of the output terminals. The bridge circuit also includes first and second switching transistors connected together in series across the input terminals. A transformer is provided having first and second windings thereon respectively connected to the first and second switching transistors for alternately applying forward biasing base drive current to the first and second transistors. A third winding on the transformer is connected in series from the junction of the two transistors to a second one of the output terminals for purposes of supplying a squarewave voltage across the output terminals for driving the lamp circuit. A starter circuit serves to start the half-bridge circuit by initially turning on one of the switching transistors in such a manner that while one transistor is being forward biased into conduction, the other transistor is reverse biased.

16 Claims, 3 Drawing Sheets

LAMP DRIVER CIRCUIT

BACKGROUND AND FIELD OF THE INVENTION

This invention relates to the art of lamp drivers and, more particularly, to circuitry for driving a lamp circuit with an AC squarewave voltage at a relatively high frequency.

The invention may be applied for driving both filament lamps as well as gaseous discharge lamps and will be described in conjunction with both herein.

PRIOR ART

It has been known in the prior art to operate gaseous discharge lamps with alternating voltage. This is desirable in the AC operation of a metal halide lamp. The lamp will burn independent of physical orientation with more consistent spectral emissions compared to DC operation. However, operation directly from a power line sinusoidal wave source has proved to be difficult due to reignition on successive half cycles which is aggravated by the comparatively slow rise of the sine wave voltage. This may be alleviated to a large extent by operating such lamps at a high frequency, such as on the order of 20 to 50 kHz. However, it has been found that operation of such lamps, and particularly metal halide lamps, at such high frequencies subjects the lamps to destructive acoustive resonances. This has been noted in the J. Davenport U.S. Pat. No. 4,170,746. That patent discloses a manner of operating such lamps with a high frequency AC sinusoidal signal within certain frequency bands that have been found to be relatively free of destructive acoustic resonances.

Further research has determined that such lamps may be operated at a high frequency without the destructive acoustic resonance from a squarewave AC signal as opposed to a sinusoidal AC signal. This may be explained by noting that the power spectrum for a perfect squarewave has fewer frequency components. Consequently, waveforms approaching a squarewave shape have few difficulties with resonances.

Whereas acoustic resonances occur in high pressure discharge lamps in general, they effect metal halide lamps the most, then mercury lamps and to a lesser extent sodium lamps where the pressure is not as high. Consequently, all of these lamps benefit from being operated with high frequency squarewave signals.

Lamps that do not exhibit acoustic resonances may also benefit from AC excitation. Such lamps include fluorescent lamps which are difficult to operate from DC sources because the fixed polarity causes electrophoresis and cataphoresis. Excitation from an AC source avoids this. Moreover, excitation of such lamps with a high frequency helps to overcome the problems of reignition associated with twin-tube or U-shaped designs. Resistive filament lamps benefit from high frequency operation because the wire cannot follow the instantaneous power variations, thereby providing a constant operating temperature. This, in turn, improves filament life, provides constant light output, and eliminates flicker. Further, in applications where a low-voltage filament is required to provide optimum optical design, the voltage may be obtained from a higher voltage source using a very compact high-frequency transformer.

An important consideration in deciding what type of circuit may be employed for providing such a high frequency signal deals with the complexity of the circuitry to be employed. This has a direct bearing on the component count and, hence, the expense of the circuitry. A circuit capable of producing such a high frequency squarewave with a relatively low component count may take the form of a self-oscillating half bridge circuit. One such circuit is illustrated in FIG. 8 of the O. Nilssen U.S. Pat. No. 4,184,128. That patent, in FIG. 8, discloses a circuit including a pair of switching transistors connected together in series across a D.C. voltage source forming one side of a bridge. A pair of capacitors are connected in series across the voltage source forming another side of the bridge. The output is taken between the junctions of the transistors and the capacitors. However, in this patent the transistors are switched under the control of separate saturable inductor means that are noncoupled.

In accordance with one aspect of the present invention, a circuit is proposed which is similar to that set forth in Nilssen, supra, but wherein the component count is further reduced by employing a single saturable core transformer to control switching of both switching transistors.

Still further, a half bridge circuit of the type disclosed in FIG. 8 of Nilssen, supra, requires a starting circuit to trigger one of the transistors into conduction after which the operation will be that of a self-oscillating circuit. Nilssen, at FIG. 8, discloses a starting circuit including a resistor and a capacitor connected together in series across a D.C. voltage source. The junction of the resistor and capacitor is connected to the base of one of the switching transistors by way of a relatively low voltage breakover means taking the form of a Diac. Once the capacitor has been charged to a level sufficient for the Diac to break down and present a low impedance, the capacitor will discharge through the base to the emitter of the transistor to thereby trigger that transistor into conduction, whereupon the circuit then operates as a self-oscillating half bridge circuit. In Nilssen, this starting circuit continues to charge and discharge providing a repetitive oscillation. Thus, once the current flow during starting reaches a zero level, the Diac will return to a high impedance and again permit the capacitor to charge and then discharge through the Diac. In this arrangement, it is possible for the Diac to stay conductive once it has broken down to present a low impedance and thereby cause direct current to continue to flow into the base of its associated switching transistor.

In accordance with another aspect of the present invention, a different type of starting circuit is proposed which when triggered operates to positively turn on one of the switching transistors while at the same time positively turn off the other of the switching transistors. Moreover, the proposed circuitry operates to prevent direct current from thereafter flowing into the base of the transistor that was initially triggered on.

SUMMARY OF THE INVENTION

In accordance with one aspect of the present invention, there is provided a lamp driver circuit for use in driving a lamp circuit with an AC squarewave signal at a relatively high frequency. This includes a self-oscillating half-bridge circuit having a pair of input terminals for connection across a DC voltage supply, such as a battery or full wave rectified line voltage, and a pair of output terminals for connection across a lamp circuit including a lamp to be energized. The bridge circuit includes a pair of capacitors connected together in series across the input terminals and having a junction therebetween which is connected to a first one of the output terminals. The bridge circuit also includes first and second transistor switches which are connected together in series across the input terminals. A transformer having a single saturable core is provided with first and second windings thereon. These windings are respectively connected to the first and second transistor switches for alternately applying base drive current to the first and second transistor switches. A third winding on the core is connected in series with the junction of the first and second transistors and a second one of the output terminals for energization by current in a circuit between said junctions that supplies a high frequency squarewave signal across the output terminals for driving the lamp circuit.

In accordance with a still further aspect of the present invention, a starter circuit is provided for initially turning on one of the transistor switches. This includes a capacitor connected in a series charging circuit with the first winding across the input terminals so as to receive charging current from the voltage supply. A voltage breakdown trigger means connected across the series charging circuit, inclusive of the first winding and the capacitor, is responsive to a charge voltage developed across the capacitor attaining a given level. This causes the trigger means to break down from presenting a normal high impedance to presenting a low impedance to the capacitor. The capacitor then discharges through the trigger means to cause a current pulse to flow in each of first and second windings such that one of the transistor switches is forward biased into conduction while the other is reverse biased.

Still further in accordance with the invention, the first and second windings are wound on the transformer core in directions relative to each other such that when the trigger means breaks down, the current pulse flowing in the first winding reverse biases the first transistor switch while the current pulse flowing in the second winding forward biases the second transistor switch into conduction.

Still further in accordance with another aspect of the present invention, an additional starting circuit is employed for use in energizing gaseous discharge lamps for providing an initial high voltage for starting such a lamp and thereafter providing a low running voltage for the running operation of the lamp.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
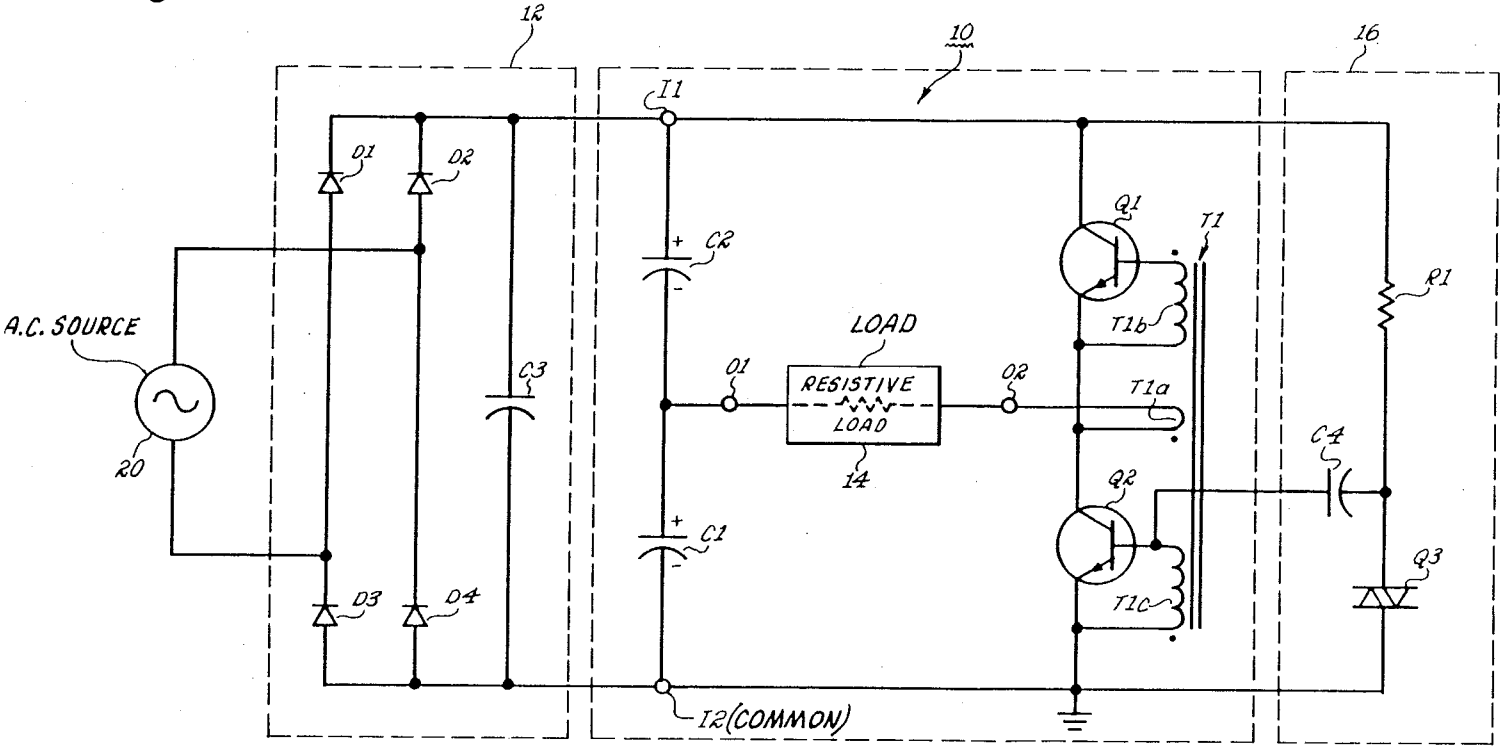
FIG. 1 is a schematic circuit diagram illustrating one embodiment of a self-oscillating half bridge circuit in accordance with the invention.

Reference is now made to FIG. 1 which illustrates one embodiment of the invention including a self-oscillating half-bridge circuit 10 coupled to a DC voltage supply 12 for purposes of driving a load taking the form of a lamp circuit 14. As will be brought out hereinafter, the drive for the lamp circuit takes the form of an AC squarewave voltage at a relatively high frequency on the order of 25 kHz. The initial starting of the half-bridge circuit 10 is accomplished with a starting circuit 16 which, as will be described below, serves to initially turn on one of the two switching transistors to cause the bridge circuit to commence oscillation which will then be continuous.

The self-oscillating half-bridge circuit 10 as shown in FIG. 1 has a pair of input terminals I1 and I2 which are connected across the DC voltage supply 12 and a pair of output terminals O1 and O2 which are connected across a lamp circuit 14 to be energized. The bridge circuit also includes a pair of capacitors C1 and C2 which are connected together in series across the input terminals I1 and I2. The junction of these capacitors is connected to the output terminal O1. The bridge also includes a pair of switching transistors Q1 and Q2 which, as shown in FIG. 1, have their collector to emitter circuits connected together in series across the input terminals I1 and I2. As shown, the transistors Q1 and Q2 are NPN transistors, although PNP transistors or other semiconductor switches may be employed.

A single saturable core transformer T1 is provided having thereon windings T1a, T1b, and T1c. Winding T1a connects the junction of transistors Q1 and Q2 with the output terminal O2. Windings T1b and T1c are respectively employed for controlling the operation of transistors Q1 and Q2. Thus, winding T1b is connected directly across the base to emitter circuit of transmitter Q1 whereas winding T1c is connected directly across the base to emitter circuit of transistor Q2. These windings are wound on the transformer core so as to have the polarities as indicated by the polarity dots in FIG. 1.

Once the bridge circuit 10 is triggered into conduction, oscillations are established and sustained by the current flowing through the primary winding T1a on the transformer. The frequency of oscillation is dependent upon the time it takes for the core of the transformer to saturate and withdraw base drive from the respective conducting transistor. Thus, when transistor Q2 is conducting, it receives base drive from winding T1c permitting current to flow through the load 14 by way of capacitor C2 and thence through the load and thence through winding T1a and the collector to emitter circuit of transistor Q2. During this period, transistor Q1 is turned off due to the polarity of the windings. Once the core saturates, the base drive is withdrawn from the transistor Q2 and base drive is supplied to transistor Q1 permitting current to flow in the opposite direction through the load 14 by current flowing through the collector to emitter circuit of transistor Q1 and thence through winding T1a, the load 14 and thence through capacitor C1.

In the bridge arrangement illustrated in FIG. 1, the capacitors C1 and C2 preferably exhibit the same capacitive values such as on the order of 0.5 microfarads. Capacitor C3, in the DC supply 12 to be discussed hereinafter, preferably has a capacitance on the order of 1.0 microfarads. In such a bridge arrangement, if the DC voltage across the input terminals I1–I2 has a value 2V, then the midpoint between the capacitors, i.e, at output terminal 01, has an average value of one-half that of the supply voltage or V. The circuit can be characterized as a constant voltage output type because, within its capacity of supplying current, it tries to maintain a peak voltage of V across the load. During each conducting half cycle there is some charging and discharging of capacitors C1 and C2. If these capacitors are too small, the voltage at the midpoint can vary about the average value of V and the charging and discharging current through the load deviates from a squarewave by taking on droop. In order to maintain a squarewave current wave shape through the load and a square voltage wave shape across the load, capacitors C1 and C2 must be sufficiently large. Thus, a preferred value of the capacitors is on the order of 0.5 microfarads as discussed hereinbefore.

In some applications, such as lighting systems for automotive vehicles, the DC voltage supply source 12 may take the form of a battery for supplying DC voltage to the bridge circuit 10 which in turn supplies high frequency squarewave signals to the load 14. One significant aspect of this circuit is the voltage step down feature wherein the voltage supplied to the load will be one-half that of the input voltage. In some applications this will eliminate the need for an output voltage transformer and in other applications it will allow operation of low voltage lamps from higher voltage supplies. For example, this voltage step down feature has applications in aircraft lighting when it is considered that aircraft commonly employ 12 or 24 volt batteries. Boats employ 12, 24 and 32 volt batteries depending on size. Also, forklift trucks and similar industrial vehicles tend to use 36 or 48 volt batteries. Another application of interest is in the automotive field. Automobiles in use today typically use low voltage batteries on the order of 12 volts. However, there is a definite move on the part of automotive manufacturers to increase that in the future due to the increased use of electronics. Thus, there is a probability that automotive batteries in the future will be substantially larger than 12 volts, such as on the order of 48 volts and possibly 96 volts. While lamps can be made to operate directly from any voltage, there are certain optical considerations which depend on the filament being of certain physical size and shape. These factors often dictate that a specific, usually low voltage on the order of 8 volts should be used for optimum design. It is therefore seen that such an application may be satisfied by employing the lamp driver circuit described herein as a means of reducing the voltage supplied to a lamp load.

For applications requiring operation from an AC power source, the DC voltage supply 12 may take the form as shown in FIG. 1 which employs a full wave bridge rectifier including diodes D1, D2, D3 and D4 connected across an AC voltage source 20. This may take the form of a 120 or 240 volt AC line voltage source. The capacitor C3 is connected across the output of the bridge to provide a filtered output voltage.

Attention is now directed to the starting circuit 16 which is employed for starting the self-oscillating half-bridge circuit 10. The starting circuit includes a resistor R1 and a capacitor C4 which are connected together in series with winding T1c across the DC voltage supply source and a SIDAC Q3 is connected across a series circuit comprising capacitor C4 and winding T1C. A SIDAC is similar to a DIAC in that it is a solid state device which exhibits a relatively high impedance until the voltage across its terminal rises to a specific breakdown voltage level whereupon it exhibits a low impedance permitting current to flow through it. DIAC's typically have breakover voltages in the range of 30 volts, whereas a SIDAC may have a breakdown voltage on the order of 90 or 120 volts.

In operation, the capacitor C4 receives charging current from the DC voltage supply 12 by way of the resistor R1 and charges toward the level of the voltage supply. When the capacitor C4 is charged to a sufficient level, the SIDAC Q3 breaks down and the capacitor discharges through the SIDAC Q3 and the winding T1C. Upon close examination, it will be noted that when the SIDAC Q3 is triggered into conduction it connects the positively charged side of capacitor C4 to ground potential causing a negative pulse to be applied to the base of transistor Q2, thus assuring that transistor Q2 is reverse biased. Since the transformer windings T1c and T1b are coupled by the transformer with the polarities indicated in FIG. 1, this will cause a positive pulse to be supplied to the base of transistor Q1 triggering this transistor into conduction. This insures that transistor Q1 is triggered into conduction and transistor Q2 is reverse biased. Moreover, if the SIDAC Q3 continues conducting, no direct current will continue to flow into the base of transistor Q2 due to the D.C. blocking action of capacitor C4. Once the starting circuit 16 has triggered one of the transistors Q1 and Q2 into conduction, as discussed above, the oscillations will be sustained by the load current flowing through the primary of transformer T1.

In the discussion given thus far, the load 14 has been primarily considered as being a resistive load between output terminals O1 and O2. However, it is anticipated that the driver circuit will also be employed with gaseous discharge lamps in which cases the load 14 includes a gaseous discharge lamp in series with a resistive filament ballast so as to appear overall as a resistive load. Moreover, to achieve start up of such a gaseous discharge tube, a suitable starting circuit may be provided which will permit starting while at the same time not interfere with the normal running of the lamp.

Figure 2:
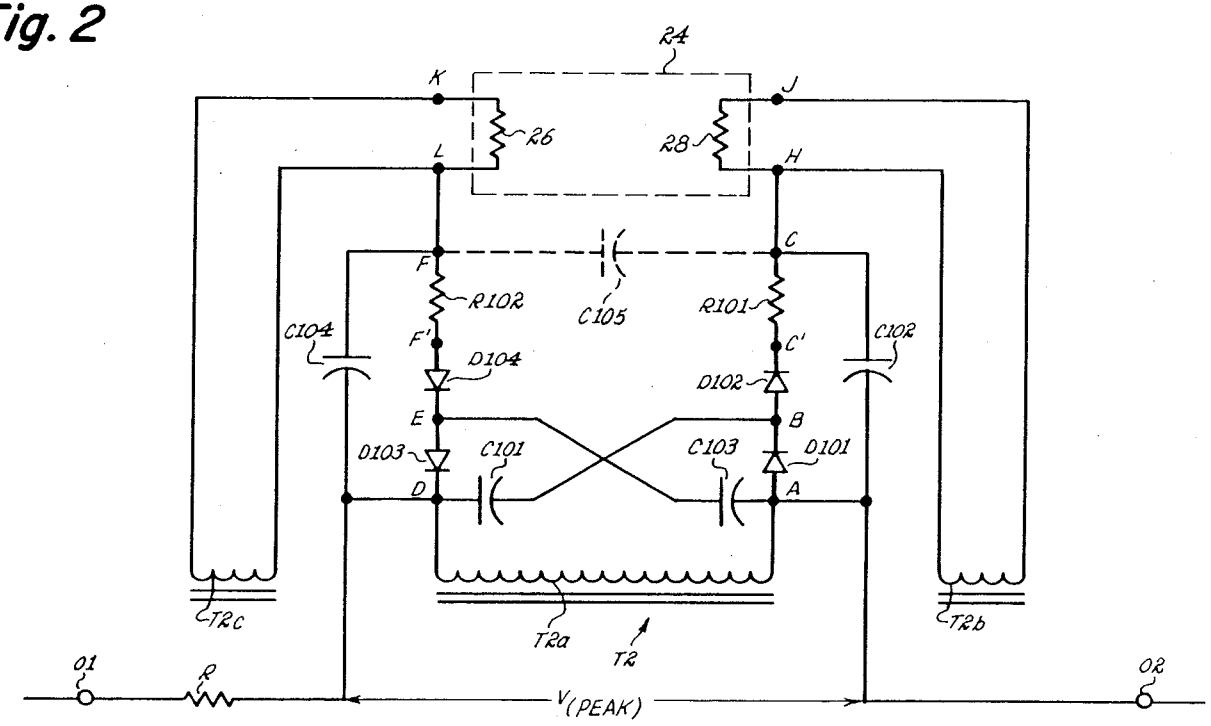
FIG. 2 is a schematic circuit diagram illustrating one embodiment of the starter circuit for use in conjunction with the circuit of FIG. 2 for operating gaseous discharge lamps.

Reference is now made to FIG. 2 which, in accordance with the present invention, presents a lamp load which includes a resistive ballast element R together with a gaseous discharge lamp 24 connected together in series across the output terminals O1 and O2 of the circuitry in FIG. 1. The circuitry of FIG. 2 presents a suitable breakdown voltage multiplying circuit which serves to initiate operation of the lamp 24 and then operate in a run-bypass mode so as to not interfere with the normal running of the lamp.

A small transformer T2 is used to provide cathode heating for the lamp while very little current flows through the primary winding T2a permitting this to be a relatively small transformer. The multiplying circuit acts to produce a peak step-up voltage on the order of five times the input voltage supplied across the terminals O1 and O2 and an average step up value on the order of four times. In addition to the transformer T2, the major elements employed in this circuit include diodes D101 through D104, capacitors C101 through C104 and resistors R101 and R102. As shown in FIG. 2, the transformer T2 has a primary winding T2a as well as secondary windings T2b and T2c, with the secondary windings being employed to respectfully provide heating of filaments 26 and 28 of the lamp 24. The ratio of turns employed on the transformer is such that the primary winding T2a has on the order of 145 turns whereas windings T2b and T2c each have on the order of ten turns. The capacitors C102 and C104 serve as energy storage elements for the voltage multiplication process and also serve the function of bypassing the high frequency drive signal around the DC path once lamp 24 is running. Consequently, these capacitors C102 and C104 may be made relatively large so as to present a low impedance at the AC drive frequency in cases where it is desired to maintain a square voltage and current wave shape for the gaseous discharge lamp. For example, these capacitors C102 and C104 may each be on the order or one microfarad. Capacitors C101 and C103 are selected so as to be comparatively small, only large enough to allow build up of voltage for break down, but not so large as to present significant shunting impedance during the run mode. Thus, capacitors C101 and C103 may each, for example, have a capacitance on the order or 0.005 microfarads.

Attention is now directed to the following description of operation of the bypass voltage multiplier circuit illustrated in FIG. 2. To assist in this discussion, reference should be made to the various points on the circuit designated by alphanumeric characters A through L located at various points on the circuit. Point D will be used as a common reference point. Initially, assume all capacitors are uncharged. The half bridge circuit of FIG. 1 is initially triggered into operation by a starter circuit 16. A current pulse will then flow through the primary winding T2a in FIG. 2 and by transformer action this is coupled to the cathode heating load connected across points H-J of transformer secondary T2b and points K-L of transformer secondary winding T2c. Since there is a cathode load filament present, the half bridge goes into continuous oscillation.

For a DC voltage 2V being supplied to the half bridge circuit of FIG. 1, the peak-to-peak squarewave output across the load is also 2V, and the peak value is V. Before breakdown, insufficient current flows through the load to cause significant voltage drop across the resistive ballast element R. Thus, assume that the full voltage V appears across winding T2a such that point A is considered to alternate between +V and −V relative to point D. In other words, if D is chosen as a reference, the voltage at point A swings to +V and then to −V on alternate high frequency half cycles.

Current flows through diode D101 and capacitor C101 via path A-B-D causing capacitor C101 to be charged to a voltage +V measured at point B relative to D. Current also flows through capacitor C103 and diode D103 via path A-E-D causing capacitor C103 to be charged to a voltage of +V measured from A relative to E.

On the second half cycle, point A goes negative relative to D and current flows through capacitor C101, diode D102, resistor R101, and capacitor C102, via path D-B-C-A. Since point B has been at +V relative to D due to the charge on capacitor C101, and point A is now at −V relative to D, capacitor C102 gets charged to a voltage of 2V measured from point C to A. On this same half cycle, current also flows through capacitor C104, resistor R102, diode D104, and capacitor C103 via D-F-E-A. Because of the charge on capacitor C103, the voltage at point E goes to −2V when point A goes to −V. Thus, capacitor C104 charges to a voltage of −2V measured from F relative to D.

On the third half cycle, point A goes positive to a voltage V again. The voltage across capacitor C102 is added to the voltage at point A, so the voltage at point C is "pushed" up to +3V while the voltage at F remains at −2V. Thus, a peak voltage of 5V appears across the load and the stray capacitance signified by capacitor C105. At the end of the third half cycle, the +V contribution from point A goes back to zero so point C drops back to 2V. Point F remains at −2V so the total voltage is 4V across the load.

On the fourth half cycle, point A goes negative to −V and the voltage at point C gets pulled down to +V. The total voltage across the load goes to 3V. Thus, the average is 4V, but the peaks go to 5V.

Through a combination of cathode heating and the presence of the multiplier-derived high voltage, the lamp breaks down and goes into arc. Note that during this transition, capacitor C102 and capacitor C104 store energy which helps to establish the arc, and if they were not otherwise required to be of a comparatively large value, they would still be selected to be of minimum size for this purpose. However, once the tube is in arc, capacitor C102 and capacitor C104 act as low impedance coupling capacitors and the lamp is connected directly to the half bridge oscillator output. The action of the voltage multiplier is negated by the low impedance of the arc, but it is possible for the diodes to still perform some rectification and superimpose a DC bias on the lamp if.not sufficiently bypassed.

The capacitive reactance should be quite low to totally bypass the low forward drop of the diodes and eliminate the DC bias. To get around this problem, resistors R101 and R102 are added to increase the resistance through the diode path. Negligible current flows through these resistors during the run mode, due to the shunting effect of capacitors C102 and C104, and they can be on the order of ½ watt power rating. However, for lamps which do not start promptly and require multiple dumping and recharging of the capacitors as well as direct current flow through the lamp itself, the individual wattage rating of resistors R101 and R102 should be increased to 10 watts or more. This occurs mostly with the metal halide lamps, wherein it may be determined that some DC bias is allowable and the resistors can be eliminated. Fortunately, where DC must be eliminated, as in the case of fluorescent lamps, cathode heating promotes prompt starting and the lower wattage resistors can be used.

In general, the circuit of FIG. 2, driven by the half bridge of FIG. 1, has been used to self start and operate straight bi-pin fluorescent lamps up to 40 watts, the 35 watt twin-tube, and a SOX-10, 10 watt low pressure sodium lamp. For those fluorescent lamps which are over 80 volts, the circuit was tried with both a full bridge rectifier from 240–277 VAC and the half-wave doubler from 120 VAC.

A 10 watt sodium lamp, being a 55 volt device, was operated from the same configurations, with expected large drop across the ballast filament; but in addition, was operated with a full bridge wiring from the 120 VAC line, thereby taking advantage of the voltage-halving action of the half bridge. For a 120 VAC line the peak DC voltage is nominally 150–160 volts under load, and the half bridge conveniently divides this to 75–80 volts—a more reasonable number from which to run a 55 volt lamp. For the sake of experimentation, the SOX-10 was modified to access the individual cathode leads which are twisted together in the packaged version. The use of cathode heating was a valuable aid in starting the lamp to demonstrate the capability of the half bridge. However, the addition of the multiplier circuit indicates it is possible to start this lamp without cathode heating.

For those configurations where the half bridge oscillator DC supply is derived from the 240 VAC line or doubled 120 VAC line, the voltage multiplier has been found to start all types of lamps without cathode heating. In such cases the no-load peak is 340 volts so the voltage V feeding the voltage multiplier is 170 volts, and 5 times that yields 850 volts.

Figure 3:
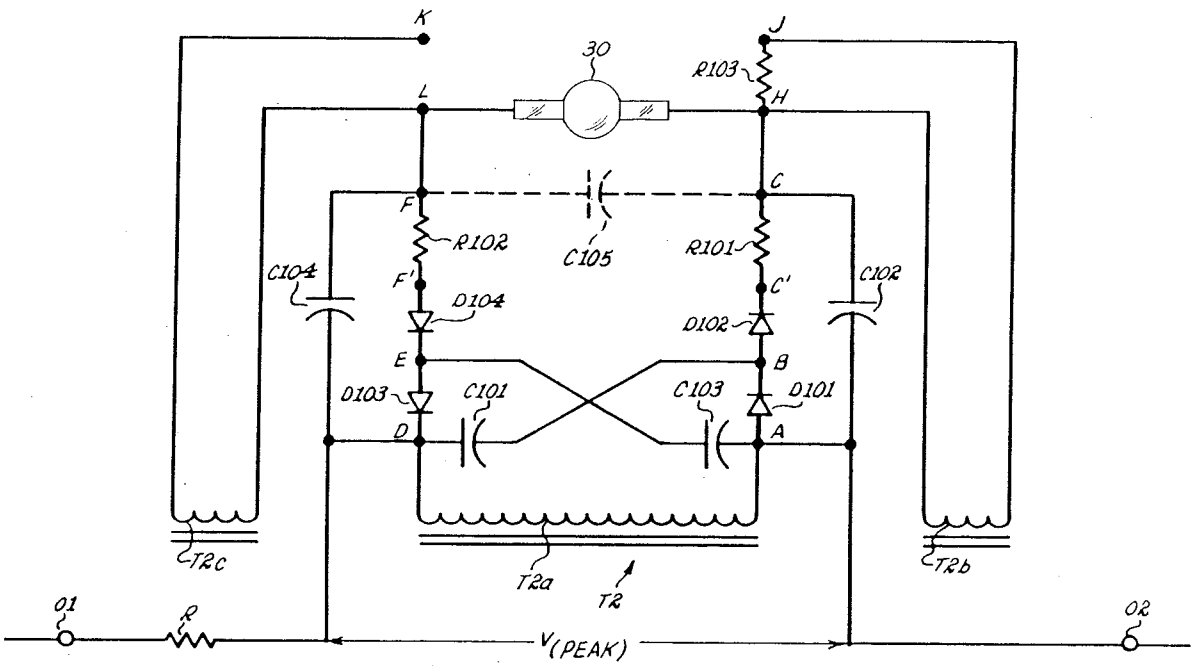
FIG. 3 is a schematic circuit diagram similar to that of FIG. 1 for operating gaseous discharge lamps that do not require cathode heating.

Reference is now made to FIG. 3 which illustrates an embodiment of the invention for operating 2-terminal gaseous discharge lamps wherein cathode heating is not required. This embodiment is quite similar to that illustrated in FIG. 2 and, consequently, like components in both Figures are identified with the same character references. In this embodiment, a two terminal lamp 30 which does not require cathode heating is connected directly across circuit points L and H. In FIG. 3, a resistor R103 replaces the heating element 28 of FIG. 2 so as to provide a minimum load across winding T2b whereby the half bridge circuit of FIG. 1 will continue to sustain oscillations sufficient to operate the voltage multiplier and generate the starting voltage. In one operating example, approximately 4 volts appeared across the resistor R103 providing losses on the range of one to two watts which is small compared to that of the resistive filament ballast. In some applications, a lamp such as lamp 30 may be started without the use of resistor R103 since the multiplier may be triggered by spikes from the starting circuit 16 of FIG. 1 alone. In such cases, then, the circuit may be improved by eliminating the secondary windings T2b and T2c of FIG. 3 and replacing the transformer T2 with a low current inductor to provide a DC path for the multiplier diodes.

Operative versions of the circuit illustrated in FIGS. 1, 2 and 3 have been successfully tested employing components as described in Table 1 corresponding to the character designations illustrated in the drawings.

TABLE 1

| Designator | Description |
|---|---|
| | Transistors |
| Q1–Q2 | NPN Motorola MJ 13004 |
| Q3 | SIDAC-120 volt breakdown Tecor K1200 |
| | Resistors |
| R1 | 10 Meg Ohms, ½ watt, 10% |
| R101, 102 | 1 Kilo Ohms, ½ watt, 10% |
| R103 | 10 Ohms, 3 watts, 10% |
| | Capacitors |
| C1–C2 | 0.5 microfarad, 600 volts, 10% |
| C3 | 1 microfarad, 600 volts, 10% |
| C102–C104 | 1 microfarad, 600 volts, 10% |
| C101–C103 | 0.005 microfarads, 1 kV, 10% |
| C4 | 0.01 microfarads, 1 kV, 10% |
| | Diodes |
| D1, D2, D3, D4 | 1N4007 |
| D101, D102, D103, D104 | 1N4007 |
| | Transformers |
| T1 | 9 turns #30 wire (3 windings) 266T125-3D3 Core (Ferroxcube Co.) |
| T2 | 1 winding, 145 turns, #30 wire, 2 windings, 10 turns, #27 wire 2213-77 core (Amidon Associates) |

Whereas the invention has been described in conjunction with preferred embodiments, it is to be appreciated that various modifications may be made without departing from the spirit and scope of the invention as defined by the appended claims.

Having described specific preferred embodiments of the invention, the following is claimed:

1. A lamp driver circuit for driving a lamp circuit with an AC squarewave voltage at a relatively high frequency, comprising:

a self-oscillating half-bridge circuit having a pair of input terminals for connection across a DC voltage supply and a pair of output terminals for connection across a said lamp circuit including a lamp to be energized;

said bridge circuit including a pair of capacitors connected together in series across said input terminals and having a junction therebetween connected to a first one of said output terminals; and said bridge circuit further including first and second transistor switching means connected together in series across said input terminals, a transformer having a single saturable core having first and second windings thereon respectively connected to said first and second switching means for alternately applying forward biasing base drive current to said first and second transistor switching means, thereby producing in said transistor switching means alternate conductive intervals, and a third winding on said core connected in series with the junction of said first and second transistor switching means and a second one of said output terminals for energization by current in a circuit between said junctions for supplying a squarewave voltage across said output terminals for driving said lamp circuit, and in which: said forward biasing base drive current in each transistor switching means during each conductive interval thereof is terminated by saturation of said core in response to passage of a predetermined pulse of current through said third winding.

2. A lamp driver circuit for driving a lamp circuit with an AC squarewave voltage at a relatively high frequency, comprising:

a self-oscillating half-bridge circuit having a pair of input terminals for connection across a DC voltage supply and a pair of output terminals for connection across a said lamp circuit including a lamp to be energized;

said bridge circuit including a pair of capacitors connected together in series across said input terminals and having a junction therebetween connected to a first one of said output terminals; and said bridge circuit further including first and second transistor switching means connected together in series across said input terminals, a transformer having a single saturable core having first and second windings thereon respectively connected to said first and second switching means for alternately applying forward biasing base drive current to said first and second transistor switching means, and a third winding on said core connected in series with the junction of said first and second transistor means and a second one of said output terminals for energization by current in a circuit between said junctions for supplying a squarewave voltage across said output terminals for driving said lamp circuit, said lamp driver circuit further including starter means for initially turning on one of said transistor switching means, including:

(a) a third capacitor connected in a series charging circuit with said first winding across said input terminals so as to receive a charging current from said voltage supply; and (b) voltage breakdown trigger means connected across said series charging circuit and responsive to the charge voltage developed across said third capacitor attaining a given level causing said trigger means to breakdown from presenting a normal high impedance to presenting a low impedance to said third capacitor whereby said third capacitor discharges through said trigger means to cause a current pulse to flow through each of said first and second windings such that one of said transistor switching means is biased into conduction while the other is reverse biased.

3. A lamp driver circuit as set forth in claim 2 wherein said first and second windings are wound on said core in directions relative to each other that when said trigger means breaks down, said current pulse flowing in said first winding reverse biases said first switching transistor means while said current pulse flowing in said second winding forward biases said second transistor switching means into conduction.

4. A lamp driver circuit as set forth in claim 2 in combination with a said lamp circuit.

5. A lamp driver circuit as set forth in claim 4 wherein said lamp circuit includes a resistive load.

6. A lamp driver circuit as set forth in claim 5 wherein said lamp circuit includes a transformer with a winding connected in series with said resistive load across said output terminals.

7. A lamp driver circuit as set forth in claim 2 wherein said DC voltage supply includes rectifying means for rectifying an AC voltage input signal and filtering means for supplying a DC voltage.

8. A lamp driver circuit as set forth in claim 4 wherein said lamp circuit includes a gaseous discharge lamp and a resistive current limiting means connected together in series across said output terminals.

9. A lamp driver circuit as set forth in claim 8 including lamp starting means connected across said gaseous discharge lamp for additionally providing a relatively high voltage pulse to initiate and establish excitation of said gaseous discharge lamp.

10. A lamp driver circuit as set forth in claim 9 wherein said lamp starting means includes voltage multiplying means for multiplying the voltage supplied by said output terminals for initially supplying said relatively high voltage pulse.

11. A lamp driver circuit as set forth in claim 10 wherein said voltage multiplier means includes bypass capacitance means connected in series with said gaseous discharge lamp and said resistive current limiting means to present a low impedance once the gaseous discharge lamp has been ignited.

12. A lamp driver circuit as set forth in claim 11 wherein said lamp starting means includes a transformer having a primary winding interposed between and connected in series with said capacitance means across said lamp.

13. A lamp driver circuit as set forth in claim 12 wherein said lamp has a pair of preheat filaments and wherein said transformer has a pair of secondary windings each connected to one of said filaments for providing initial preheating thereof.

14. A lamp driver circuit for driving a lamp circuit with an AC squarewave voltage, comprising:

a self-oscillating half-bridge circuit having a pair of input terminals for connection across a DC voltage supply and a pair of output terminals for connection across a said lamp circuit including a lamp to be energized;

said bridge circuit including a pair of capacitors connected together in series across said input terminals and having a junction therebetween connected to a first one of said output terminals;

said bridge circuit further including first and second transistor switching means connected together in series across said input terminals, transformer means showing a first and second windings thereon respectively. connected to said first and second transistor switching means, for alternately applying forward biasing base drive current to said first and second transistor switching means, and a third winding connected in a series with the junctions of said first and second transistor switching means and a second one of said output terminals for energization by current in a circuit between said junctions for supplying a squarewave voltage across said output terminals for driving said lamp circuit; and starter means energized independently of said transformer means and including energy storage means and voltage breakdown trigger means effective upon breakdown to cause said energy storage means to discharge and thereby develop a starting pulse for initially turning on said bridge circuit in such a manner as to forward bias one of said transistor switching means into conduction while at the same time reverse biasing the other one of said transistor switching means.

15. A lamp driver circuit for driving a lamp circuit with an AC squarewave voltage, comprising:

a self-oscillating half-bridge circuit having a pair of input terminals for connection across a DC voltage supply and a pair of output terminals for connection across a said lamp circuit including a lamp to be energized;

said bridge circuit including a pair of capacitors connected together in series across said input terminals and having a junction therebetween connected to a first one of said output terminals;

said bridge circuit further including first and second transistor switching means connected together in series across said input terminals, transformer means having first and second windings thereon respectively connected to said first and second transistor switching means for alternately applying forward biasing drive current to said first and second transistor switching means, and a third winding connected in series with the junction of said first and second transistor switching means and a second one of said output terminals for energization by current in a circuit between said junctions for supplying a squarewave voltage across said output terminals for driving said lamp circuit; and starter means for initially turning on said bridge circuit in such a manner as to forward bias one of said transistor switching means into conduction while at the same time reserve biasing the other one of said transistor switching means, wherein said starter means includes:

(a) a third capacitor connected in a series charging circuit with said first winding across said input terminals so as to receive a charging current from said voltage supply; and (b) voltage breakdown trigger means connected across said series charging circuit and responsive to the charge voltage developed across said third capacitor attaining a given level causing said trigger means to breakdown from presenting a normal high impedance to presenting a low impedance to said third capacitor whereby said third capacitor discharges through said trigger means to cause a current pulse to flow through each of said first and second windings such that one of said transistor switching means is biased into conduction while the other is reverse biased.

16. A lamp driver circuit as set forth in claim 15 wherein said first and second windings are wound on said core in directions relative to each other that when said trigger means breaks down, said current pulse in said first winding reverse biases said first transistor switching means while said current pulse in said second winding forward biases said second transistor switching means into conduction.

* * * * *